US008448801B2

(12) United States Patent
Rusnak et al.

(10) Patent No.: US 8,448,801 B2
(45) Date of Patent: May 28, 2013

(54) STORAGE DEVICE HAVING A COVER FITTING INNER AND OUTER CONTAINERS

(75) Inventors: John E. Rusnak, Aurora, IL (US); Lawrence John Racana, Willowbrook, IL (US); Richard Miller, Worth, IL (US); Edward B. Tucker, Yorkville, IL (US)

(73) Assignee: The Glad Products Company, Oakland, CA (US)

( * ) Notice: Subject to any disclaimer, the term of this patent is extended or adjusted under 35 U.S.C. 154(b) by 75 days.

(21) Appl. No.: 13/177,361

(22) Filed: Jul. 6, 2011
(Under 37 CFR 1.47)

(65) Prior Publication Data

US 2013/0008897 A1 Jan. 10, 2013

(51) Int. Cl.
*B65D 21/02* (2006.01)
*A47G 19/00* (2006.01)

(52) U.S. Cl.
USPC ..... 220/23.86; 220/23.83; 220/522

(58) Field of Classification Search
USPC ..... 220/23.83, 23.86, 23.87, 23.89, 212, 220/506, 521, 522, 525
See application file for complete search history.

(56) References Cited

U.S. PATENT DOCUMENTS

| | | | | |
|---|---|---|---|---|
| 2,122,746 | A * | 7/1938 | Kernahan | 229/125.24 |
| 3,275,180 | A * | 9/1966 | Optner et al. | 206/521 |
| 3,844,443 | A * | 10/1974 | Cudzik | 220/296 |
| 5,027,972 | A | 7/1991 | Bartholomew | |
| 5,377,860 | A | 1/1995 | Littlejohn et al. | |
| 5,706,974 | A | 1/1998 | Murdick et al. | |
| 6,302,268 | B1 | 10/2001 | Michaeli | |
| 7,523,839 | B2 * | 4/2009 | Savicki | 220/303 |
| 7,658,298 | B2 * | 2/2010 | Merey | 220/522 |
| 2004/0035867 | A1 | 2/2004 | Schultz et al. | |
| 2007/0000922 | A1 * | 1/2007 | Vovan et al. | 220/4.27 |
| 2007/0051689 | A1 * | 3/2007 | Anderson | 215/228 |
| 2007/0102319 | A1 | 5/2007 | Sperrazza | |
| 2008/0041850 | A1 | 2/2008 | Tucker et al. | |
| 2009/0166369 | A1 | 7/2009 | Savicki | |

* cited by examiner

*Primary Examiner* — Harry Grosso
(74) *Attorney, Agent, or Firm* — Thomas C. Feix; Stacy H. Combs

(57) ABSTRACT

A spin lock container comprising a container member having a bottom, an upper annular rim and a substantially continuous side wall extending from the bottom and terminating at the rim, the bottom and side wall defining a first member cavity, the rim including a first member skirt having a plurality of first threads, the plurality of first threads having substantially equidistant engagement points; and a closure member having a peripheral sealing portion and an inner sealing portion, the peripheral sealing portion including a sealing liner and a skirt having a plurality of second threads adapted and positioned to cooperate with the first threads, wherein sealable engagement of the container member and closure member is effectuated when the first and second threads are fully aligned and the inner sealing member is adapted to sealingly engage an inner container member, the inner container member fitting inside the outer container member when the peripheral sealing member is engaged with the outer container member.

5 Claims, 7 Drawing Sheets

STORAGE DEVICE HAVING A COVER FITTING INNER AND OUTER CONTAINERS

FIELD OF THE INVENTION

The present invention relates generally to storage devices having a cover adapted to seal an inner and an outer container. More specifically, the present invention relates to storage devices having a cover with a spin-on outer closure adapted to seal to an outer container.

BACKGROUND OF THE INVENTION

Rigid, thermoplastic food containers are generally known. These containers are substantially airtight when fully closed. Numerous types of bowl and lid assemblies and means for effecting sealable engagement of a lid on a bowl have been devised. Illustrative are the containers and engagement means disclosed in U.S. Pat. No. 6,170,696. One type of container is a spin lock container as described in U.S. Pat. No. 7,523,839, where the cover is secured to the base with a rotational threaded mechanism.

Consumers often desire to carry two separate items in a storage container. For example, a consumer may store a salad in one storage container and salad dressing in a separate container. Conventional solutions for providing a single storage device for holding multiple items have been proposed. U.S. Patent Publication No. 2007/0102319 describes a one-piece container having a first vessel and a second vessel permanently secured to and inside the first vessel. In this design, the user may not be able to, for example, pour salad dressing out of the inner vessel without spilling the contents of the outer vessel. U.S. Pat. No. 6,302,268 describes a container having an insert chamber that may release its contents into the container through a hole in the bottom of the insert chamber. To fill the insert chamber, it must be removed from the lid of the container, filled, capped and inserted, cap side down, back into the container. When the insert chamber is not in use, it must remain in place in the lid of the container, else the lid of the container would have an opening and not seal the contents within the container.

Accordingly, it would be advantageous to provide containers that address some of the problems of conventional food containers, which lack the ability to controllably ensure complete sealing of the container while providing the convenience of a removable inner container attachable to the spin-on cover.

SUMMARY OF THE INVENTION

In view of the foregoing, the present invention provides a container whose cover may secure an outer container while simultaneously securing an inner container positioned inside the outer container. The inner container may sealingly engage with an inner closure mechanism in the container cover. The outer container may sealingly engage with an outer closure mechanism by a spin-lock mechanism.

The container in accordance with one embodiment of the invention may be a spin lock container comprising a container member having a bottom, an upper annular rim and a substantially continuous side wall extending from the bottom and terminating at the rim, the bottom and the side wall defining a first member cavity, the rim having a plurality of first threads, wherein the plurality of first threads are discontinuous around the container member, the plurality of first threads comprises at least two threads and the plurality of first threads has substantially equidistant engagement points, and a closure member having a peripheral sealing portion with a circumference, said sealing portion including an inner skirt portion having a substantially vertical outer wall, a connecting bead, and an outer skirt portion having a substantially vertical inner wall and connecting to the inner skirt portion at the connecting bead, the outer skirt portion inner wall having a plurality of second threads adapted and positioned to cooperate with the first threads, wherein the plurality of second threads are discontinuous around the closure member and the plurality of second threads comprises at least two threads, wherein sealable engagement of the container member and the closure member is effectuated when the sealing liner is in contact with the rim over a substantial length thereof. The closure member includes an inner closure portion sealingly engageable with an inner container closure portion of an inner container to define a substantially sealed, leak-proof, and re-sealable storage area for items such as food, condiments, or the like.

The spin lock container in accordance with one embodiment of the invention comprises a container member having a bottom, an upper annular rim and a substantially continuous side wall extending from the bottom and terminating at the rim, the bottom and the side wall defining a first member cavity, the rim having a threaded closure means, and a closure member having a peripheral sealing portion with a circumference, said sealing portion including an inner skirt portion having a substantially vertical outer wall, a connecting bead, and an outer skirt portion having a substantially vertical inner wall and connecting to the inner skirt portion at the connecting bead, the outer skirt portion inner wall having a threaded closure means, wherein sealable engagement of the container member and the closure member is effectuated when the sealing liner is in contact with the rim over a substantial length thereof. The closure member includes an inner closure portion sealingly engageable with an inner container closure portion of an inner container to define a substantially sealed, leak-proof, and re-sealable storage area for items such as food, condiments, or the like.

The spin lock container in accordance with one embodiment of the invention comprises a container member having a bottom, an upper annular rim and a substantially continuous side wall extending from the bottom and terminating at the rim, the bottom and the side wall defining a first member cavity, the rim having a plurality of first threads, wherein the plurality of first threads are discontinuous around the container member, the plurality of first threads comprises at least two threads and the plurality of first threads has substantially equidistant engagement points, and a closure member having a peripheral sealing portion with a circumference, said sealing portion including an inner skirt portion having a substantially vertical outer wall, a connecting connecting bead, and an outer skirt portion having a substantially vertical inner wall and connecting to the inner skirt portion at the connecting bead, the outer skirt portion inner wall having a plurality of second threads adapted and positioned to cooperate with the first threads, wherein the plurality of second threads are discontinuous around the closure member and the plurality of second threads comprises at least two threads. The closure member includes an inner closure portion sealingly engageable with an inner container closure portion of an inner container to define a substantially sealed, leak-proof, and re-sealable storage area for items such as food, condiments, or the like.

The spin lock container in accordance with one embodiment of the invention comprises a container member as described in U.S. Pat. No. 7,523,839, and incorporated in its entirety herein. The container has a bottom, an upper annular rim and a substantially continuous side wall extending from the bottom and terminating at the rim, the bottom and side wall defining a first member cavity, the rim including a first member skirt having a plurality of first threads, the plurality of first threads having substantially equidistant engagement points; and a closure member having a peripheral sealing portion, the sealing portion including a skirt having a plurality of second threads adapted and positioned to cooperate with the first threads, wherein sealable engagement of the container member and closure member is effectuated when the first and second threads are fully aligned. The closure member includes an inner closure portion sealingly engageable with an inner container closure portion of an inner container to define a substantially sealed, leak-proof, and re-sealable storage area for items such as food, condiments, or the like.

In an alternative embodiment, each of the plurality of first threads comprises a raised projection that projects outwardly from the container member skirt and each of the plurality of second threads comprises a guide adapted to receive one of the plurality of threads. In another embodiment of the invention, a closure system for closing an opening in a container is provided, the closure system comprising a substantially U-shaped circumferentially extending guiding channel defined by an inner wall and an outer wall that are located and configured to receive between them the sealing member of the container, the sealing member having a corresponding configuration as the guiding channel and including an inner wall and an outer wall, the guiding channel outer wall including a plurality of first threads having substantially equidistant engagement points, the sealing member outer wall having a plurality of second threads adapted and positioned to cooperate with the first threads. In another embodiment of the invention, the closure system comprises a substantially U-shaped circumferentially extending guiding channel, wherein the interior of the guiding channel is defined by an inner wall and an outer wall that are located and configured to receive between them the sealing member of a container, the sealing member having a corresponding configuration as the guiding channel and including an inner wall and an outer wall, the guiding channel inner wall including a plurality of first threads having substantially equidistant engagement points, the sealing member inner wall having a plurality of second threads adapted and positioned to cooperate with the first threads.

The inner closure portion of the closure member may be sealingly engageable with the inner container closure portion of the inner container to define a substantially sealed, lead-proof, and re-sealable storage area for items such as food, condiments, or the like.

Further, the covers of the present invention may include articulation elements that allow the covers to easily flex upwardly or downwardly, sometimes referred to as articulate, either alone or when engaged with the base of the container.

The closure members (also referred to as covers) and bases (e.g., inner and outer containers) can be economically constructed from relatively thin-gauge plastic so that the user can either wash them after use or dispose of them with the view that their purchase price allows them to be used as a consumable good. The container can be readily manufactured, for example, with conventional vacuum thermoforming or injection molding equipment. The cover can be made from a semi-transparent material to ensure satisfactory visibility of the container's contents. The container can be suitable for refrigerator, freezer, microwave, and machine dishwasher use.

The features of the present invention will become apparent to one of ordinary skill in the art upon reading the detailed description, in conjunction with the accompanying drawings, provided herein.

DETAILED DESCRIPTION OF THE INVENTION

Figure 1:
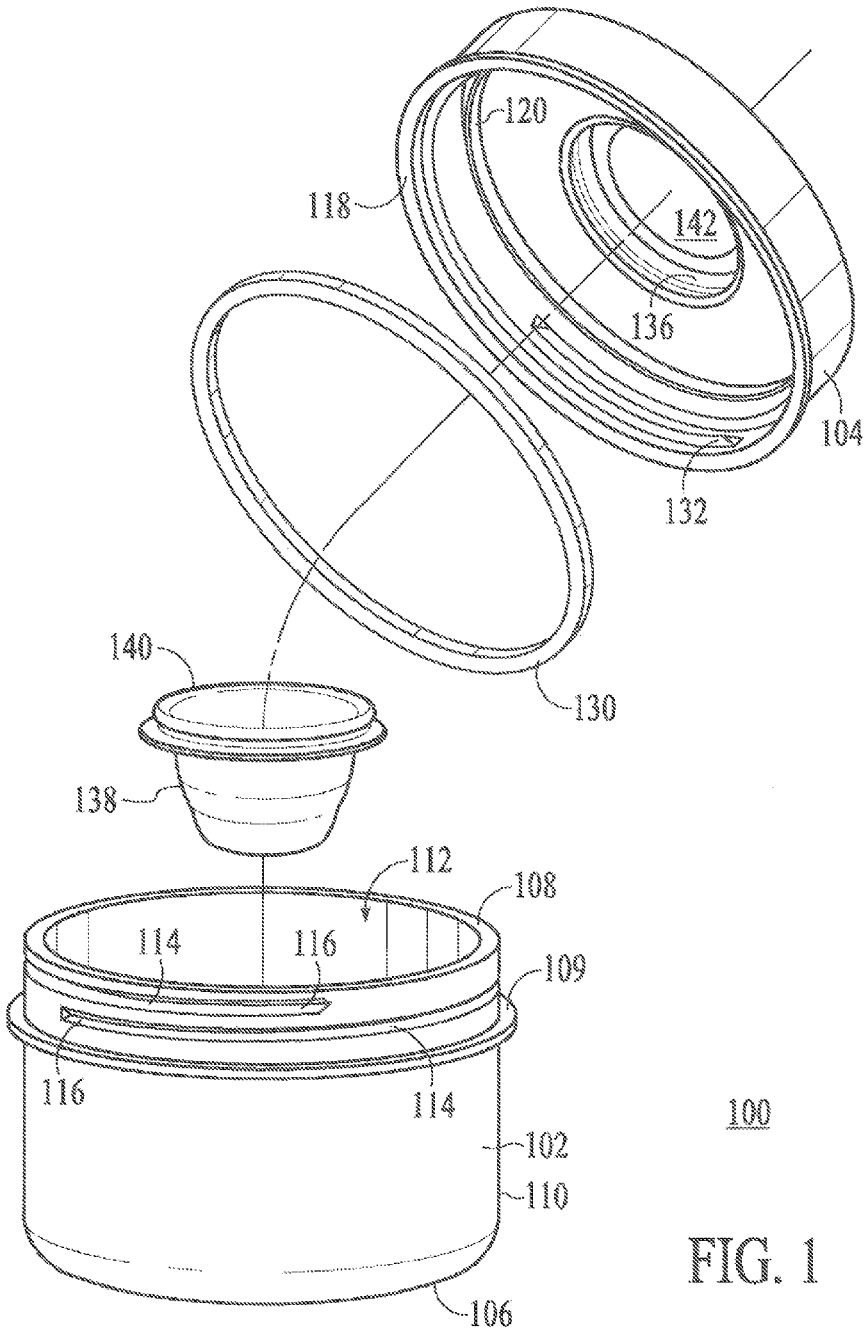
FIG. 1 is an exploded view of a container, according to the invention.

Reference will now be made to the drawings wherein like numerals refer to like parts throughout. For ease of description, the components of the various embodiments disclosed herein are described in the normal (upright) operating position, and terms such as upper, lower, horizontal, etc., are used with reference to this position. It will be understood, however, that components and embodiments of the invention may be manufactured, stored, transported, used, and sold in an orientation other than the position described.

Figures illustrating components of disclosed embodiments show some conventional mechanical elements that are known and that will be recognized by one skilled in the art. The detailed descriptions of such elements are not necessary to an understanding of the invention, and accordingly, are herein presented only to the degree necessary to facilitate an understanding of the novel features of the present invention.

All publications, patents and patent applications cited herein, whether supra or infra, are hereby incorporated by reference in their entirety to the same extent as if each individual publication, patent or patent application was specifically and individually indicated to be incorporated by reference.

As used herein and in the claims, the term "comprising" is inclusive or open-ended and does not exclude additional unrecited elements, compositional components, or method steps. Accordingly, the term "comprising" is broader than the more restrictive terms "consisting essentially of" and "consisting of".

It must be noted that, as used in this specification and the appended claims, the singular forms "a," "an" and "the" include plural referents unless the content clearly dictates otherwise. Thus, for example, reference to a "surfactant" includes two or more such surfactants.

Unless define otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise indicated.

The term "container", as used herein, is meant to mean and include any storage container for storing food in a refrigerator. A container may be made of any suitable material, depending upon the product therein. For example, a container may be made of plastic.

Figure 2:
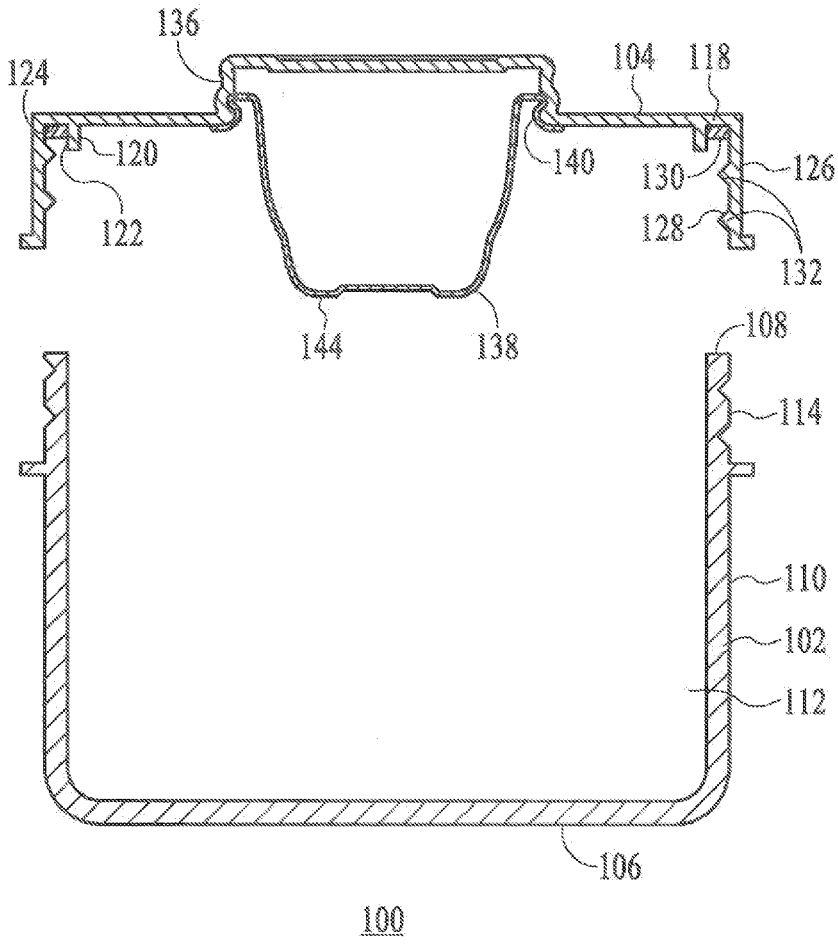
FIG. 2 is a cross-sectional view of the container shown in FIG. 1.

Referring now to FIG. 1, there is shown one embodiment of the spin lock container, designated generally 100. As illustrated in FIG. 1, the container 100 includes a container member 102 and a selectively detachable, cylindrical closure member 104 (also referred to as lid 104 or cover 104). The container 100 has a bottom 106, an upper annular rim 108 and a substantially continuous side wall 110 extending from the bottom 106 and terminating at the rim 108. The container 100 may have a lip 109 along the side wall 110 below the rim 108. The lip 109 may engage the sealing member 118 of the closure member 104 when the closure member 104 is engaged with the container member 102. The bottom 106 and the side wall 110 define a cavity 112. The rim 108 may include a plurality of threads 114 that have substantially equidistant engagement points 116. As shown in FIGS. 1 and 2, the closure member 104 has a peripheral and circumferential sealing member 118 where the sealing member 118 has an inner skirt portion 120 having a substantially vertical outer wall 122. The sealing member 118 has a connecting bead 124 and an outer skirt portion 126 having a substantially vertical inner wall 128 and connecting to the inner skirt portion 120 at the connecting bead 124. A sealing liner 130 is situated between the inner skirt portion outer wall 122 and the outer skirt portion inner wall 128 along the connecting bead 124 and the sealing liner 130 is attached around the entire circumference of the peripheral sealing member 118. The outer skirt portion inner wall 128 has a plurality of threads 132 that are positioned to cooperate with the plurality of threads 114 of the rim 108. In a preferable example, the plurality of threads 114 of the rim 108 are discontinuous around the container member 102 and the plurality of threads 114 includes at least two threads. In a preferable example, the plurality of threads 132 are discontinuous around the closure member 104 and the plurality of threads 132 includes at least two threads. In other suitable examples, there are only single continuous threads 114, 132. When the container member 102 and the closure member 104 are engaged with the treads 132 and 114, the sealing liner 130 is in contact with the rim 108 over a substantial length of the rim 108.

The closure member 104 may include an inner closure portion 136 formed about an exterior circumference of a recessed portion 142 of the closure member 104. In some embodiments, the recessed portion 142 may be centrally disposed in the closure member 104. The inner closure portion 136 is sealing engageable with an inner container closure portion 140 of an inner container 138 by a friction engagement, or snap-fit attachment mechanism. The inner closure portion 136 of the closure member 104 can be sealingly engaged with the inner container closure portion 140 of the inner container 138 to provide a leak-resistant, re-sealable closure. When the inner closure portion 136 of the closure member 104 and the inner container closure portion 140 of the inner container 138 are abutted and sealingly engaged with each other, the closure member 104 and the inner container 140 define a substantially sealed storage area within the inner container 138.

The inner container 138, once sealed to the closure member 104, may fit inside the outer container 102 when the closure member 104 is engaged with the outer container 102. This configuration may provide a substantially sealed storage area within the inner container 138 removably nested inside a substantially sealed storage area within the outer container 102.

Figure 3:
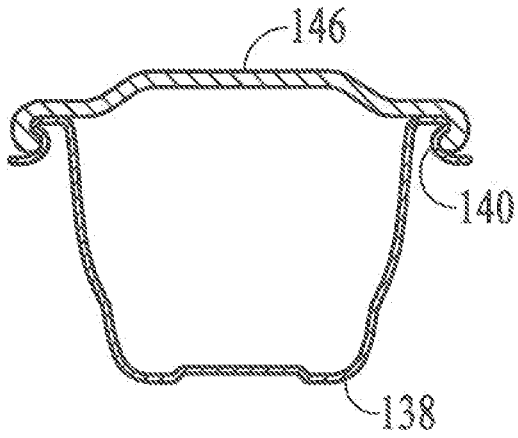
FIG. 3 is a cross-sectional view of a portion of the container of FIG. 2 with a lid.

The inner container 138 may have its own lid 146 (FIG. 3) that may sealingly engage with the inner container 138 at the inner container closure portion 140. In this configuration, an item, for example, salad dressing, may be stored in the inner container 138 and covered with its lid. When a user desires, the lid of the inner container 138 may be removed and the inner container 138 may be sealingly engaged with the closure member 104.

The inner container 138 may be pre-filled with an item, such as a dip, dressing, condiment, or the like, and sealed at the time of manufacturer. A user may unseal the inner container 138 and sealingly engage the inner container 138 to the cover 104 at the appropriate time. For example, salad dressing may be pre-filled into the inner container 138 and sealed with a foil seal. When the user prepares a salad in the outer container 102, the user may remove the seal on the inner container 138, attach the inner container 138 to the closure member 104 and seal the closure member 104 on the outer container 102. This configuration provides a convenient way to carry a salad and salad dressing separately. When the user desires to mix the salad and dressing, they may simply remove the closure member 104 from the outer container 102 and remove the inner container 138 from the cover 132. The user may then simply pour the contents of the inner container 138 onto the contents within the outer container 102.

In an alternate embodiment, the inner container 138 may be used to hold, for example, crushed ice. When the inner container 138 is sealed to the closure member 104 and the closure member 104 is sealed to the outer container 102, the ice in the inner container 138 may help keep cold the contents within the outer container 102. The same concept may be used for keeping items warm. Alternatively, other substances may be stored in the inner container 138, such as an odor or moisture absorber. The inner container 138 may be gas permeable to allow air to pass between the inner container 138 and the outer container 102.

The size of the inner container 138 may vary depending on the desired use. In some embodiments, the inner container bottom 144 may, when the inner container 138 is sealingly engaged to the closure member 104 and the closure member 104 is sealingly engaged to the outer container 102, come close to or contact the outer container bottom 106. In other embodiments, the inner container bottom 144 may, when the inner container 138 is sealingly engaged to the closure member 104 and the closure member 104 is sealingly engaged to the outer container 102, be shorter and a gap may be present between the outer container bottom 106 and the inner container bottom 144, as in FIG. 2.

Figure 4:
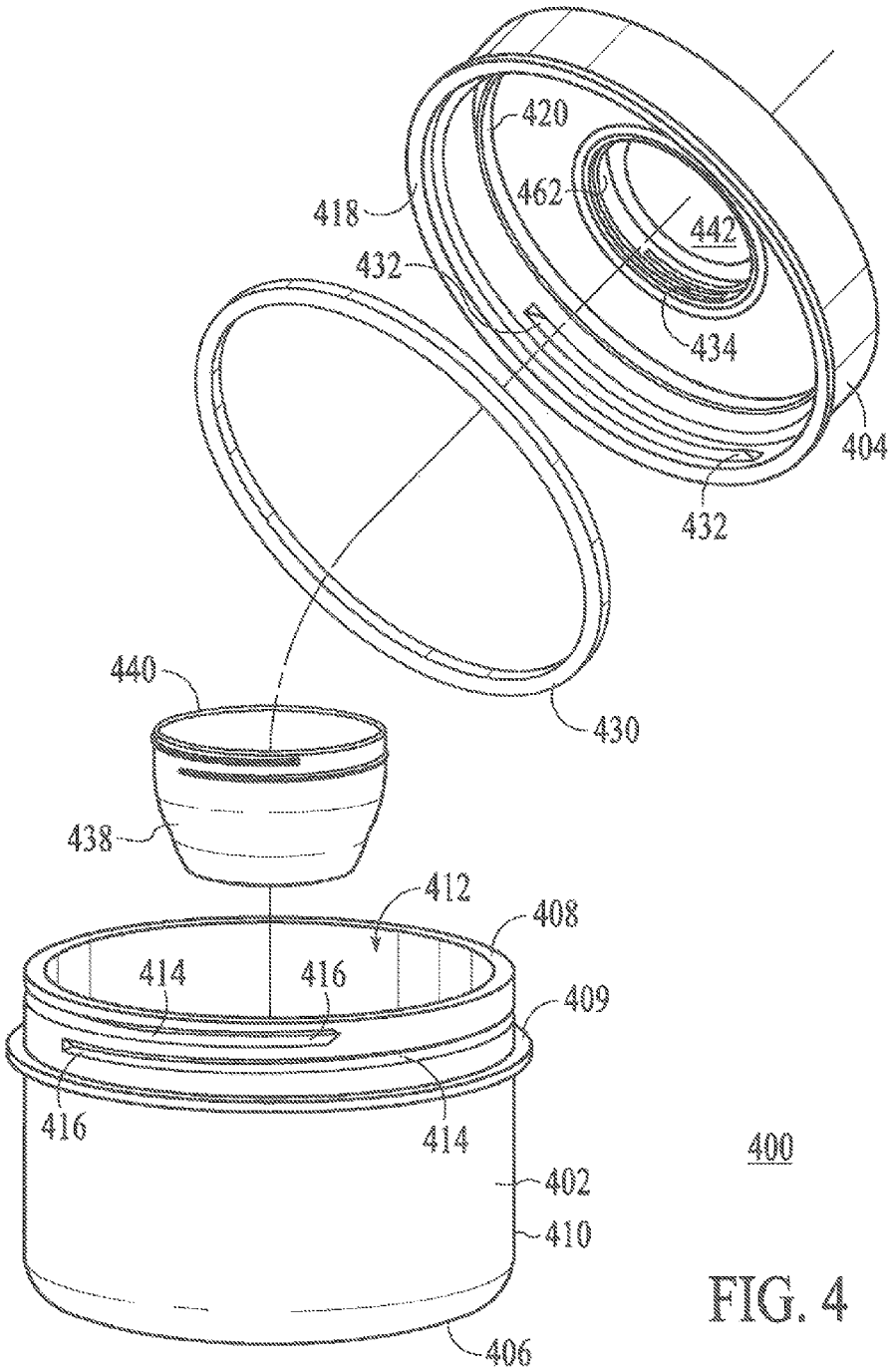
FIG. 4 is an exploded view of a container, according to the invention.
Figure 5:
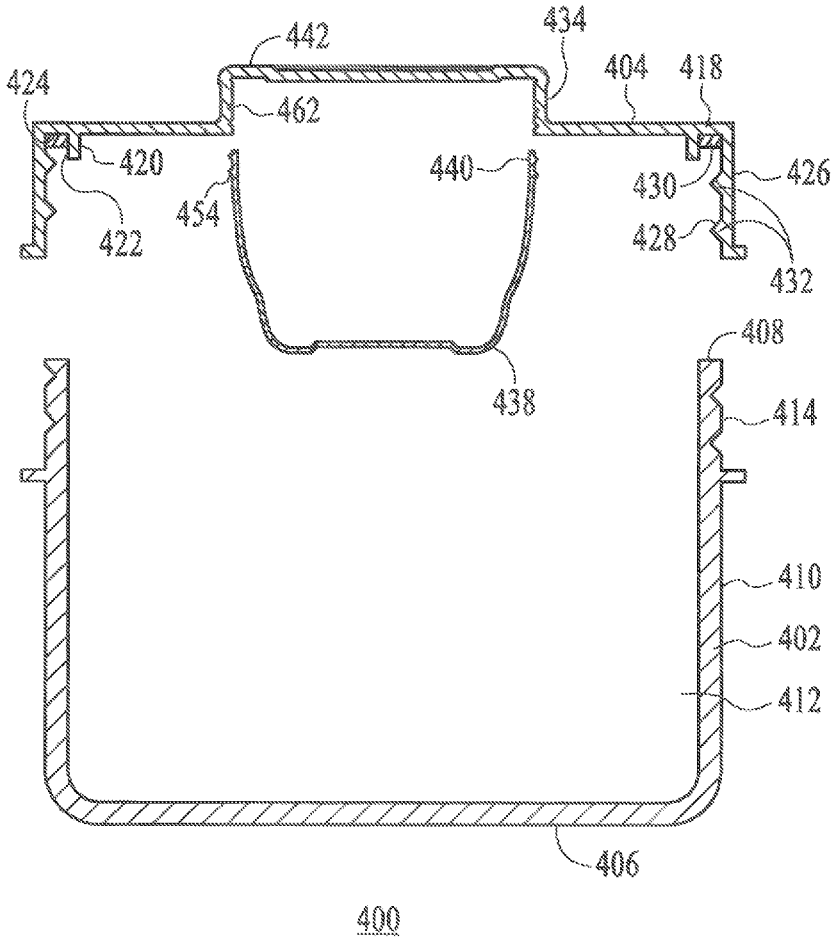
FIG. 5 is a cross-sectional view of the container shown in FIG. 4.

Referring now to FIG. 4, there is shown one embodiment of the spin lock container, designated generally 400. As illustrated in FIG. 4, the container 400 includes a container member 402 and a selectively detachable, cylindrical closure member 404 (also referred to as lid 404 or cover 404). The container 400 has a bottom 406, an upper annular rim 408 and a substantially continuous side wall 410 extending from the bottom 406 and terminating at the rim 408. The container 400 may have a lip 409 along the side wall 410 below the rim 408. The lip 409 may engage the sealing member 418 of the closure member 404 when the closure member 404 is engaged with the container member 402. The bottom 406 and the side wall 410 define a cavity 412. The rim 408 may include a plurality of threads 414 that have substantially equidistant engagement points 416. As shown in FIGS. 4 and 5, the closure member 404 has a peripheral and circumferential sealing member 418 where the sealing member 418 has an inner skirt portion 420 having a substantially vertical outer wall 422. The sealing member 418 has a connecting bead 424 and an outer skirt portion 426 having a substantially vertical inner wall 428 and connecting to the inner skirt portion 420 at the connecting bead 424. A sealing liner 430 is situated between the inner skirt portion outer wall 422 and the outer skirt portion inner wall 428 along the connecting bead 424 and the sealing liner 430 is attached around the entire circumference of the peripheral sealing member 418. The outer skirt portion inner wall 428 has a plurality of threads 432 that are positioned to cooperate with the plurality of threads 414 of the rim 408. When the container member 402 and the closure member 404 are engaged with the treads 432 and 414, the sealing liner 430 is in contact with the rim 408 over a substantial length of the rim 408.

The closure member 404 may include an inner closure portion 434 formed about an exterior circumference of a recessed portion 442 of the closure member 404. In some embodiments, the recessed portion 442 may be centrally disposed in the closure member 404. The thread or threads 462 of the inner closure portion 434 are sealing engageable with the thread or threads 454 of the inner container closure portion 440 of an inner container 438. The inner closure portion 434 of the closure member 404 can be sealingly engaged with the inner container closure portion 440 of the inner container 438 to provide a leak-resistant, re-sealable closure. When the inner closure portion 434 of the closure member 404 and the inner container closure portion 440 of the inner container 438 are sealingly engaged with each other, the closure member 404 and the inner container 440 define a substantially sealed storage area within the inner container 438.

The inner container 438, once sealed to the closure member 404, may fit inside the outer container 402 when the closure member 404 is engaged with the outer container 402. This configuration may provide a substantially sealed storage area within the inner container 438 removably nested inside a substantially sealed storage area within the outer container 402.

Figure 6:
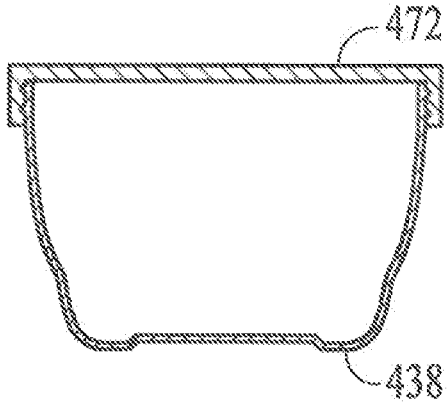
FIG. 6 is a cross-sectional view of a portion of the container of FIG. 5 with a lid.

The inner container 438 may have its own lid 472 (FIG. 6) that may sealingly engage with the inner container 438. In this configuration, an item, for example, salad dressing, may be stored in the inner container 438 and covered with its lid. When a user desires, the lid of the inner container 438 may be removed and the inner container 438 may be sealingly engaged with the closure member 404.

The size of the inner container 438 may vary depending on the desired use. In some embodiments, the inner container 438 may, when sealingly engaged to the closure member 404 and the closure member 404 is sealingly engaged to the outer container 402, come close to or contact the bottom of the outer container 402. In other embodiments, the inner container 438 may, when sealingly engaged to the closure member 404 and the closure member 404 is sealingly engaged to the outer container 402, be shorter and a gap may be present between the outer container 402 and the inner container 438.

Figure 7:
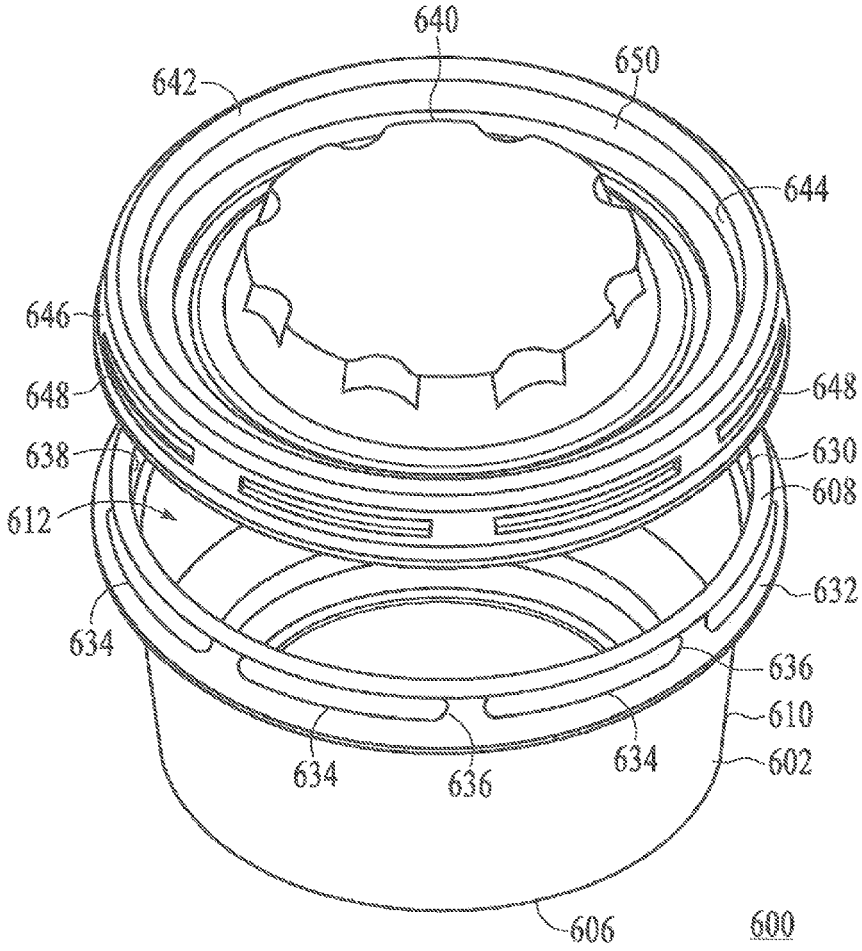
FIG. 7 is a exploded view of a container of the invention.

FIG. 7 shows a container 600 of an embodiment of the invention comprising a container member 602 having a bottom 606, an upper annular rim 608 and a substantially continuous side wall 610 extending from said bottom 606 and terminating at said rim 608, said bottom 606 and side wall 610 defining a first member cavity 612, said rim 608 including an inner wall 630 and an outer skirt 632, said skirt 632 having a plurality of first threads 634, wherein said plurality of first threads 634 are discontinuous around the container member 602, said plurality of first threads 634 comprises at least two threads and said plurality of first threads has substantially equidistant engagement points 636, said inner wall 630 of said container member 602 having a length extending in a substantially vertically downward direction sufficient to define a first sealing surface 638, and a closure member 640 having a peripheral sealing portion 642, said sealing portion 642 including an inner wall 644 and an outer skirt 646, said skirt 646 having a plurality of second threads 648 adapted and positioned to cooperate with said first threads 634, wherein said plurality of second threads 648 are discontinuous around the closure member 640 and said plurality of second threads 648 comprises at least two threads, said inner wall 644 of said closure member 640 having a length extending in a substantially vertically downward direction sufficient to define a second sealing surface 650, wherein a sealing liner 652 (shown in FIG. 8) is attached between said closure inner wall 644 and said closure skirt 646, wherein sealable engagement of said container member 602 and closure member 640 is effectuated when said first threads 634 and second threads 648 are in a sealing position with said first sealing surface 638 in contact with said second sealing surface 650 over a substantial length thereof, and said rim 608 is sealingly engaged with said sealing liner 652.

Figure 8:
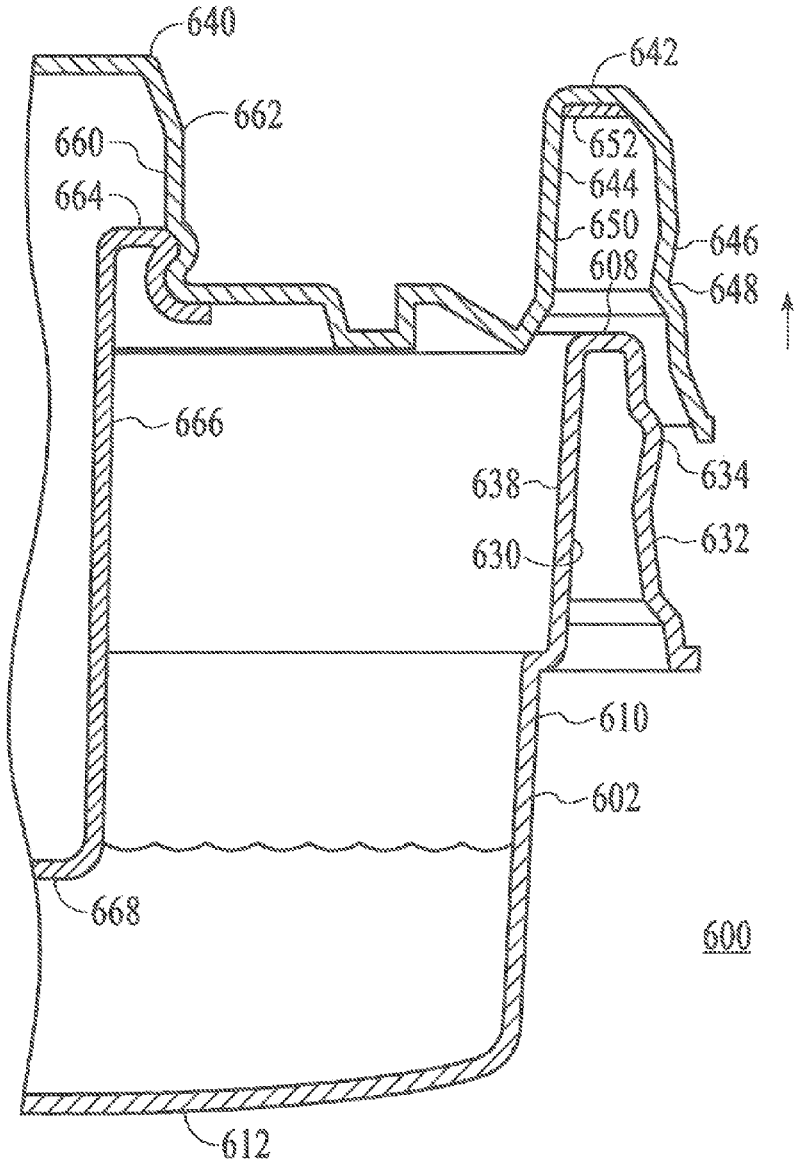
FIG. 8 is a partial front plane, sectioned view of the container shown in FIG. 7.

FIG. 8 shows a partial cross-sectional view of the container 600 comprising an outer container member 602 having an upper annular rim 608 and a substantially continuous side wall 610 terminating at said rim, said rim 608 including an inner wall 630 and an outer skirt 632, said skirt 632 having a plurality of first threads 634, said inner wall 630 of said container member 602 having a length extending in a substantially vertically downward direction sufficient to define a first sealing surface 638, and a closure member 640 having a peripheral sealing portion 642, said sealing portion 642 including an inner wall 644 and an outer skirt 646, said skirt 646 having a plurality of second threads 648 adapted and positioned to cooperate with said first threads 634, said inner wall 644 of said closure member having a length extending in a substantially vertically downward direction sufficient to define a second sealing surface 650, wherein a sealing liner 652 is attached between said closure inner wall 644 and said closure skirt 646, wherein sealable engagement of said container member 602 and closure member 640 is effectuated when said first threads 634 and second threads 648 are in a sealing position with said first sealing surface 638 in contact with said second sealing surface 650 over a substantial length thereof, and said rim 608 is sealingly engaged with said sealing liner 652.

The closure member 640 may include an inner closure portion 660 formed about an exterior circumference of a recessed portion 662 of the closure member 640. In some embodiments, the recessed portion 662 may be centrally disposed in the closure member 640. The inner closure portion 660 is sealing engageable with an inner container closure portion 664 of an inner container 666 by a friction engagement, or snap-fit attachment mechanism. The inner closure portion 660 of the closure member 640 can be sealingly engaged with the inner container closure portion 664 of the inner container 666 to provide a leak-resistant, re-sealable closure. When the inner closure portion 660 of the closure member 640 and the inner container closure portion 664 of the inner container 666 are abutted and sealingly engaged with each other, the closure member 640 and the inner container 666 define a substantially sealed storage area within the inner container 666.

The inner container 666, once sealed to the closure member 640, may fit inside the outer container 602 when the closure member 640 is engaged with the outer container 602. This configuration may provide a substantially sealed storage area with the inner container 666 removably nested inside a substantially sealed storage area within the outer container 602.

The size of the inner container 666 may vary depending on the desired use. In some embodiments, the inner container bottom 668 may, when the inner container 666 is sealingly engaged to the closure member 640 and the closure member 640 is sealingly engaged to the outer container 602, come close to or contact the outer container bottom 612, as in FIG. 8. In other embodiments, the inner container bottom 668 may, when the inner container 666 is sealingly engaged to the closure member 640 and the closure member 640 is sealingly engaged to the outer container 602, be shorter and a gap may be present between the outer container bottom 612 and the inner container bottom 668.

As stated, although the invention is described with respect to a cylindrical bowl and lid assembly, the engagement means of the spin lock container can be employed on various containers having cylindrical openings. Such containers include, by way of example, soda bottles, milk containers, bleach bottles, etc.

As will be appreciated by one having ordinary skill in the art, numerous suitable materials may be chosen to fabricate the spin lock container of the invention. Preferably, the container comprises polyolefin or like material. The noted material is sufficiently resiliently deformable to facilitate cooperation between the container threads and the closure threads. The noted material also readily accommodates the preferred thermoforming process. The container can be made from any suitable plastic and can be made by any suitable technique, such as co-extrusion, lamination, injection molding, vacuum thermoforming, or overmolding. Vacuum thermoforming is typically the most economical means for forming the container. As is well know in the art, vacuum thermoforming involves heating a suitable plastic sheet of material to a temperature at which the sheet becomes formable into a shape that is set as the plastic sheet cools. As used herein, a suitable plastic sheet is a plastic sheet that may be readily used by the vacuum thermoforming process. The heated plastic sheet is made to conform to the surface features of a single surface "male" tool by drawing the heated sheet of plastic to the surface of the tool by the force of a vacuum applied to the tool. In vacuum thermoforming, the sealed air space between the heated plastic and mold is evacuated to draw the heated plastic to contact the single male surface of the mold. Injection molding of a plastic article involves heating suitable plastic material in the form of pellets or granules until a melt is obtained. The melt is next forced into a split-die mold, sometimes referred to as a split-die tool, where it is allowed to "cool" into the desired shape. Both the bottom surface and the top surface of the plastic article are formable by the split-die mold. Thus, articles may by formed by the injection molding process that have side cross-sectional profiles of varying non-uniform thickness. After the plastic melt cools, the split-die mold is opened and the article is ejected. Since, the mold is separable, undercut surface on the plastic article may be relieved from the split-die mold when it is opened. Injection molding, well know in the art, is typically used to form plastic articles that have large undercuts and substantially varying thicknesses in side cross-sectional profile. As used herein undercuts are said to be large if a molded plastic article having undercut features is difficult or impossible to remove from a single-surface vacuum thermoforming mold after it is formed and cooled.

The container can be fabricated by vacuum thermoforming a clarified polypropylene homopolymer material. In another embodiment, the container may be fabricated by vacuum thermoforming a clarified random copolymer polypropylene material. Other plastic materials which would be suitable for fabricating the container by vacuum thermoforming include PS (polystyrene), CPET (crystalline polyethylene terephthalate), APET (amorphous polyethylene terephthalate), HDPE (high density polyethylene), PVC (polyvinyl chloride), PC (polycarbonate), and foamed polypropylene. The material used can be generally transparent to allow a user to view the contents of the container.

The sealing liner is of a different softer material from the container or the rim of the container member. One measure of the properties of the different materials is Shore hardness. The sealing liner preferably has a lower Shore hardness than the container or rim of the container member. The Shore hardness is measured with an apparatus known as a Durometer and consequently is also known as 'Durometer hardness'. The hardness value is determined by the penetration of the Durometer indenter foot into the sample. Because of the resilience of rubbers and plastics, the indentation reading my change over time—so the indentation time is sometimes reported along with the hardness number. The ASTM test method designation is ASTM D2240 00 and is generally used in North America. The results obtained from this test are a useful measure of relative resistance to indentation of various grades of polymers. However, the Shore Durometer hardness test does not serve well as a predictor of other properties such as strength or resistance to scratches, abrasion, or wear, and should not be used alone for product design specifications. Shore hardness is often used as a proxy for flexibility (flexural modulus) for the specification of elastomers. The correlation between Shore hardness and flexibility holds for similar materials, especially within a series of grades from the same product line, but this is an empirical and not a fundamental relationship. For example, polypropylene homopolymer has a Shore D hardness of 78. Typical olefin copolymers of polypropylene can have a Shore D hardness of about 73. Low density polyethylene has a Shore D hardness of about 55. Elastomers are in the range of Shore A hardness below the hardness level measured by Shore A hardness.

The optional sealing liner can be hollow, for example a tubular structure. The sealing liner can be foamed, for example a foamed elastomer, or can be solid, for example a polypropylene copolymer overmolded film. The sealing liner can be attached to the container by insertion, welding including adhesive welding, or overmolding.

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims. Any combination of the above described elements in all possible variations thereof is encompassed by the invention unless otherwise indicated herein or otherwise clearly contradicted by context. While the invention is described herein in connection with certain preferred embodiments, there is no intent to limit the present invention to those embodiments.

What is claimed is:

1. A container, comprising:

a container member having a bottom, an upper annular rim and a substantially continuous side wall extending from the bottom and terminating at the rim, the bottom and the side wall defining a first member cavity, the rim having a first threaded connection;

an inner container member having an inner container closure portion, a bottom, an upper annular rim, and a substantially continuous side wall extending from the bottom and terminating at the rim, the bottom and the side wall defining a second member cavity; and a closure member having a peripheral sealing member, said peripheral sealing member including an inner skirt portion having a substantially vertical outer wall, a connecting bead, and an outer skirt portion having a substantially vertical inner wall and connecting to the inner skirt portion at the connecting bead, the outer skirt portion inner wall having a second threaded connection, wherein the closure member includes a centrally disposed recessed portion, said recessed portion is located above a top of the lid and not extending below the lid surface;

wherein the recessed portion of the closure member includes an inner closure portion connected to the top of the lid and wherein said inner closure portion is perpendicular to the top of the lid, wherein the inner closure portion is adapted to sealingly engage the inner container closure portion of the inner container member, the inner container member fitting inside the outer container member when the peripheral sealing member is engaged with the outer container member.

2. The container of claim 1, wherein the inner container member has threads to engage the inner closure portion.

3. The container of claim 1, wherein the inner container member is adapted to attach to the inner closure portion with a snap-fit attachment mechanism.

4. The container of claim 1, wherein the inner closure portion is formed about an exterior circumference of the recessed portion of the closure member.

5. The container of claim 1, wherein the outer container rim includes an inner wall and an outer skirt and the skirt has the plurality of first threads.

* * * * *